US007361077B2

(12) United States Patent
Mardero et al.

(10) Patent No.: US 7,361,077 B2
(45) Date of Patent: Apr. 22, 2008

(54) TUBE AND DUCT EDGE CLEANER

(75) Inventors: Steve Mardero, Winnipeg (CA); Don Girard, Cartier (CA); Miguel Guzzi, Winnipeg (CA); Wayne Miller, Stonewell (CA); Mathew Shewfelt, Winnipeg (CA); Gary Tarapacki, Headingley (CA); Dave McDougall, Winnipeg (CA)

(73) Assignee: The Boeing Company, Chicago, IL (US)

( * ) Notice: Subject to any disclaimer, the term of this patent is extended or adjusted under 35 U.S.C. 154(b) by 476 days.

(21) Appl. No.: 11/107,032

(22) Filed: Apr. 15, 2005

(65) Prior Publication Data

US 2006/0243302 A1 Nov. 2, 2006

(51) Int. Cl.
*B24B 5/40* (2006.01)

(52) U.S. Cl. ..... 451/65; 451/61; 15/104.14

(58) Field of Classification Search ..... 451/65, 451/66, 51, 61; 15/104.14, 104.095, 104.09, 15/104.05, 104.04, 104.03; 29/82.021, 81.02, 29/81.11

See application file for complete search history.

(56) References Cited

U.S. PATENT DOCUMENTS 71,471 A * 11/1867 Eggleston ..... 451/473
3,286,407 A * 11/1966 Lockwood ..... 451/121
4,238,867 A 12/1980 Ruggero et al.
4,372,003 A * 2/1983 Toelke ..... 15/88
4,403,363 A * 9/1983 Hess ..... 15/104.04
4,433,448 A 2/1984 True
4,530,127 A * 7/1985 Roberts ..... 15/104.04
4,600,444 A 7/1986 Miner
4,862,549 A 9/1989 Criswell et al.
5,493,748 A 2/1996 Santo
6,065,173 A 5/2000 White
6,106,370 A 8/2000 Carter
6,393,645 B1 5/2002 Kadinger
6,813,797 B1 11/2004 Kadinger
7,263,737 B1 * 9/2007 Walsh et al. ..... 15/104.04

* cited by examiner

*Primary Examiner*—Robert Rose
(74) *Attorney, Agent, or Firm*—Klein, O'Neill & Singh, LLP

(57) ABSTRACT

An apparatus for cleaning a portion of a tubular member comprises a platform; a motor operatively connected to a shaft; a first sliding base driven by the shaft to revolve generally parallel to the platform; a first pinch thumb, including an outer surface, mounted onto the first sliding base to revolve with the first sliding base; a first pinch finger, including an outer surface, mounted onto the first sliding base; and an adjustable clamp arm adapted to secure a tubular member above the platform and adjacent the first sliding base; wherein, after the adjustable clamp arm secures the tubular member above the platform, the first sliding base revolves to urge the first pinch thumb to move radially outward to contact an inner diameter of the tubular member and the first pinch finger moves radially inward to contact an outer diameter of the tubular member.

20 Claims, 5 Drawing Sheets

TUBE AND DUCT EDGE CLEANER

BACKGROUND OF THE INVENTION

1. Field Of the Invention

The present invention relates to a system and method of cleaning the surface of metals, and particularly to a system and method for removing corrosion from the edges of aluminum tubes and ducts to prepare for soldering, welding, and brazing.

2. Background

Soldering, welding, or brazing of pipe, tubing, or ducts ("tubes") require that the mating surfaces of the tubes be thoroughly cleaned to present oxide-free and contaminant-free surfaces that can be joined together. Joints are required to be free of porosity and voids so that the joints in the tubes do not leak.

Conventionally, tubes are cleaned by manually removing oxides and dry contaminants by rubbing the joint surfaces with steel wool, emery cloth, or wire brushes. For example, oxides may be removed from tube surfaces with drill mounted bottle brushes.

Cleaning of a large number of tube components can be tedious and time-consuming using conventional methods for cleaning tube surfaces. For example, a conventional method uses a stainless steel bottle brush mounted in an air drill that rotates at approximately 2000 rpm. The drill is clamped to a work bench and the tubing is manually moved across the edge of the bottle brush to attempt to remove material from the tube end. The cycle time for this conventional method is about three minutes per edge.

Consequently, conventional cleaning methods can be time consuming, lead to inefficiencies due to operator inattention and error, and result in high processing costs. Manually removing material from tubing edges often entails variability of the amount of material removed and inconsistent quality of material removal.

Therefore, what is desired is an apparatus and method for cleaning tubing that saves time, minimizes inefficiencies due to operator inattention and error, minimizes processing costs (such as labor costs), and which effectively and consistently cleans tubing edges.

SUMMARY OF THE INVENTION

In one aspect of the present invention, an apparatus for cleaning a portion of a tubular member comprises a platform; a motor operatively connected to a shaft; a first sliding base driven by the shaft to revolve generally parallel to the platform; a first pinch thumb, including an outer surface, mounted onto the first sliding base to revolve with the first sliding base; a first pinch finger, including an outer surface, mounted onto the first sliding base; and an adjustable clamp arm adapted to secure a tubular member above the platform and adjacent the first sliding base; wherein, after the adjustable clamp arm secures the tubular member above the platform, the first sliding base revolves to urge the first pinch thumb to move radially outward to contact an inner diameter of the tubular member and the first pinch finger moves radially inward to contact an outer diameter of the tubular member.

In another aspect of the present invention, an apparatus for cleaning a portion of a tubular member comprises a motor operatively connected to a shaft; a slide rail operatively connected to the shaft and situated to revolve above a platform; a first sliding base slidably attached to the slide rail for revolving with the slide rail; a second sliding base slidably attached to the slide rail for revolving with the slide rail and the first sliding base; a first pinch thumb, including an outer surface, mounted onto the first sliding base; a second pinch thumb, including an outer surface, mounted onto the second sliding base; an abrasive material held on the outer surface of each of the first pinch thumb and the second pinch thumb; a first pinch finger, including an outer surface, mounted onto the first sliding base; a second pinch finger, including an outer surface, mounted onto the second sliding base; an abrasive material held on the outer surface of each of the first pinch finger and the first pinch thumb; and an adjustable clamp arm adapted to secure a tubular member above the platform; whereby when the slide rail is revolved, about the longitudinal axis of the tubular member, the first sliding base and the second sliding base will move radially outward such that the first pinch thumb and the second pinch thumb are moved radially outward to contact an inner diameter of the tubular member and the first pinch finger and the second pinch finger will be moved radially inward to contact the outer diameter of the tubular member.

In yet another aspect of the present invention, an apparatus for cleaning a tubular member comprises a slide rail mounted onto a platform; a first sliding base slidably attached to the slide rail; a second sliding base slidably attached to the slide rail; a first pinch thumb, including an outer surface, mounted onto the first sliding base; a second pinch thumb, including an outer surface, mounted onto the second sliding base; an abrasive strip wrapped around the outer surface of the first pinch thumb and the second pinch thumb; a first pinch finger, including an outer surface, mounted onto the first sliding base; a second pinch finger, including an outer surface, mounted onto the second sliding base; an abrasive strip wrapped around the outer surface of the first pinch finger and the second pinch finger; and an adjustable clamp arm adapted to secure a tubular member in a vertical position adjacent the first sliding base and the second sliding base; whereby when the slide rail is revolved (or rotated), about the longitudinal axis of the tubular member, the first base and the second base will move radially outward to move the first pinch thumb and the second pinch thumb radially outward to abrade the inner diameter of the tubular member and the first pinch finger and the second pinch finger will move radially inward to abrade the outer diameter of the tubular member.

In still another aspect of the present invention, a method for edge cleaning a portion of a tubular member comprises clamping a tubular member within an adjustable clamp arm; attaching slidably a first sliding base to a slide rail; mounting a first pinch thumb onto the first sliding base; mounting a first pinch finger onto the first sliding base; and revolving the first sliding base; whereby the first sliding base will urge the first pinch thumb to move radially outward to contact an inner diameter of the tubular member and the first pinch finger will move radially inward to contact an outer diameter of the tubular member.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

The foregoing features and other features of the present invention will now be described with reference to the drawings of a preferred embodiment. In the drawings, the same components have the same reference numerals. The illustrated embodiment is intended to illustrate, but not to limit the invention. The drawings include the following Figures.

DETAILED DESCRIPTION OF THE PREFERRED EMBODIMENTS

The following detailed description is of the best currently contemplated modes of carrying out the invention. The detailed description is not to be taken in a limiting sense, but the detailed description is made merely for the purpose of illustrating the general principles of the invention, since the scope of the invention is best defined by the appended claims.

The present invention may be used for cleaning at least a portion of pipes, tubes, ducts, and the like ("tubular members") before welding, soldering, brazing, or any other joining process. Tubes and ducts used on all models of aircraft must be cleaned before welding. For example, aluminum oxide (AlO) must be removed from inside and outside of aluminum tubes around the proposed joining surfaces.

Broadly, the present invention enables safely cleaning tubing edge surfaces quickly and economically in a hands-free manner on an automatic bench-top machine. Automatic cycle times of approximately five (5) seconds per edge cleaned are obtainable, instead of the conventional manual method times of about three (3) minutes per edge. Another advantage is that the present invention offers automatic edge cleaning that reduces the cost of edge preparation and increases the quality of the edges prepared.

Figure 1:
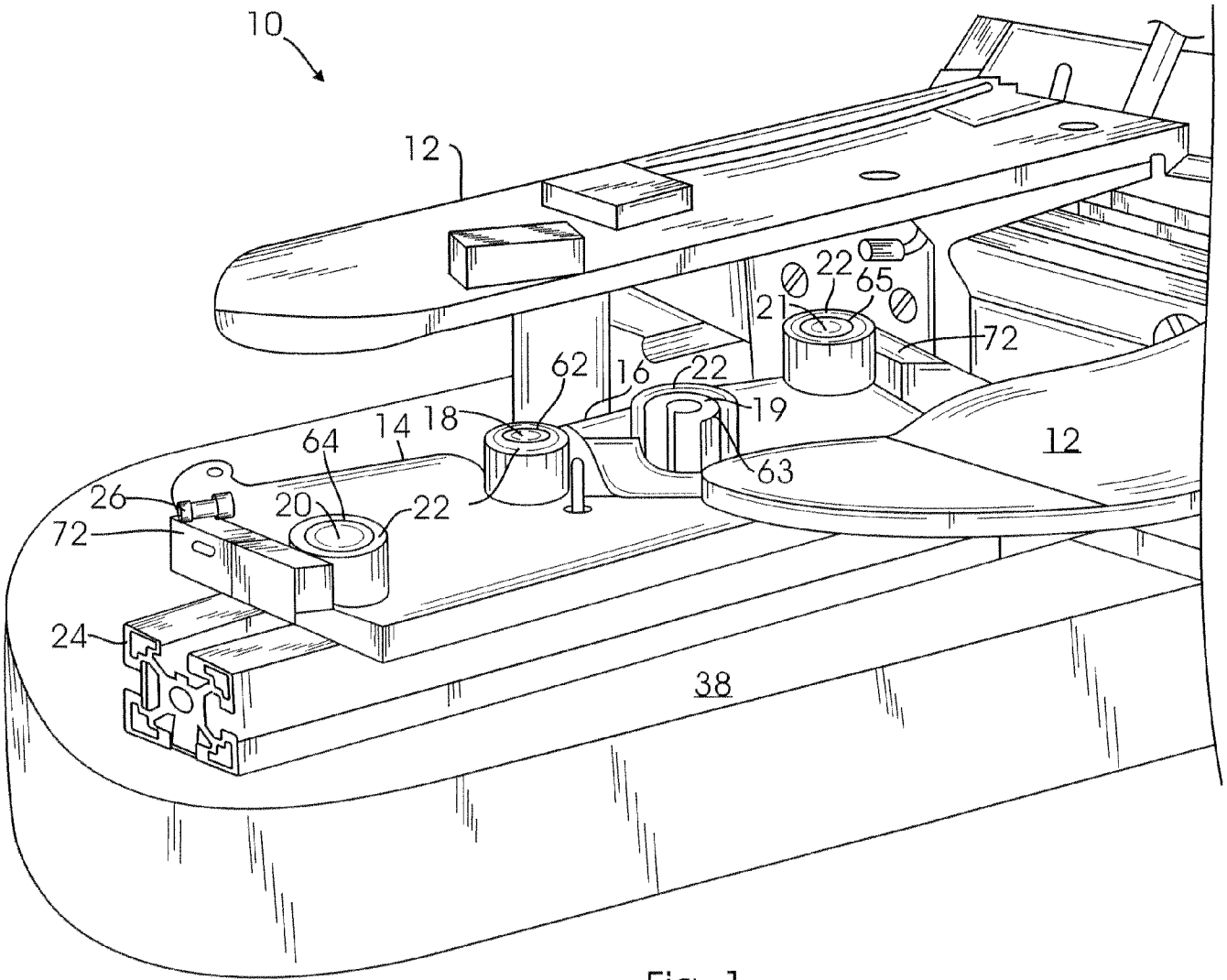
FIG. 1 is a perspective view of a cleaning apparatus for cleaning tubular members, such as pipes and ducts, according to an embodiment of the present invention.

FIG. 1 shows a cleaning apparatus 10 for cleaning tubular members, such as pipes and ducts. The cleaning apparatus 10 comprises a slide rail 24 mounted onto a platform 38. A first sliding base 14 may be slidably attached to the slide rail 24. A second sliding base 16 may also be slidably attached to the slide rail 24.

The slide rail 24 and the platform 38 may be made from any durable material, such as aluminum. The first sliding base 14 and the second sliding base 16 comprise a friction-reducing mechanical polymer, such as acetal resin, Rulon LR™ (manufactured by Saint-Gobain Performance Plastics Corporation™, of Bristol, R.I. in the United States), Turcite™ (manufactured by Busak+Shamban™, of Torrance, Calif. in the United States), nylon, UHMW-PE (ultra high molecular weight polyethylene as available from Crown Plastics Company™ of Harrison, Ohio, in the United States), or Delrin AF™ (manufactured by E.I. du Pont de Nemours and Company™, of Wilmington, Del. in the United States).

A first inner operating element 18, such as a first pinch thumb, including an outer surface 62, is mounted onto the first sliding base 14. A second inner operating element 19, such as a second pinch thumb, including an outer surface 63, is mounted onto the second sliding base 16. An abrasive material 22, such as an abrasive strip, may be held on (for example, wrapped around) the outer surface 62 of the first inner operating element 18 and the outer surface 63 of the second inner operating element 19.

The first inner operating element 18 and the second inner operating element 18 are made from the same materials as the first sliding base 14, as described above. The abrasive material 22 may be an abrasive strip or other element suitable for abrading, such as steel wool, nylon scouring pad material, sandpaper, and the like.

A first outer operating element 20, such as a first pinch finger, including an outer surface 64, is mounted onto the first sliding base 14, spaced from the first inner operating element 18. A second outer operating element 21, such as a second pinch finger, including an outer surface 65, is mounted onto the second sliding base 16, spaced from the second inner operating element 19. An abrasive material 22, such as an abrasive strip, may be held on (for example, wrapped around) the outer surface 64 of the first outer operating element 20 and the outer surface 65 of the second outer operating element 21.

The first outer operating element 20 and the second outer operating element 21 are made from the same materials as the first sliding base 14, as described above.

Figure 2:
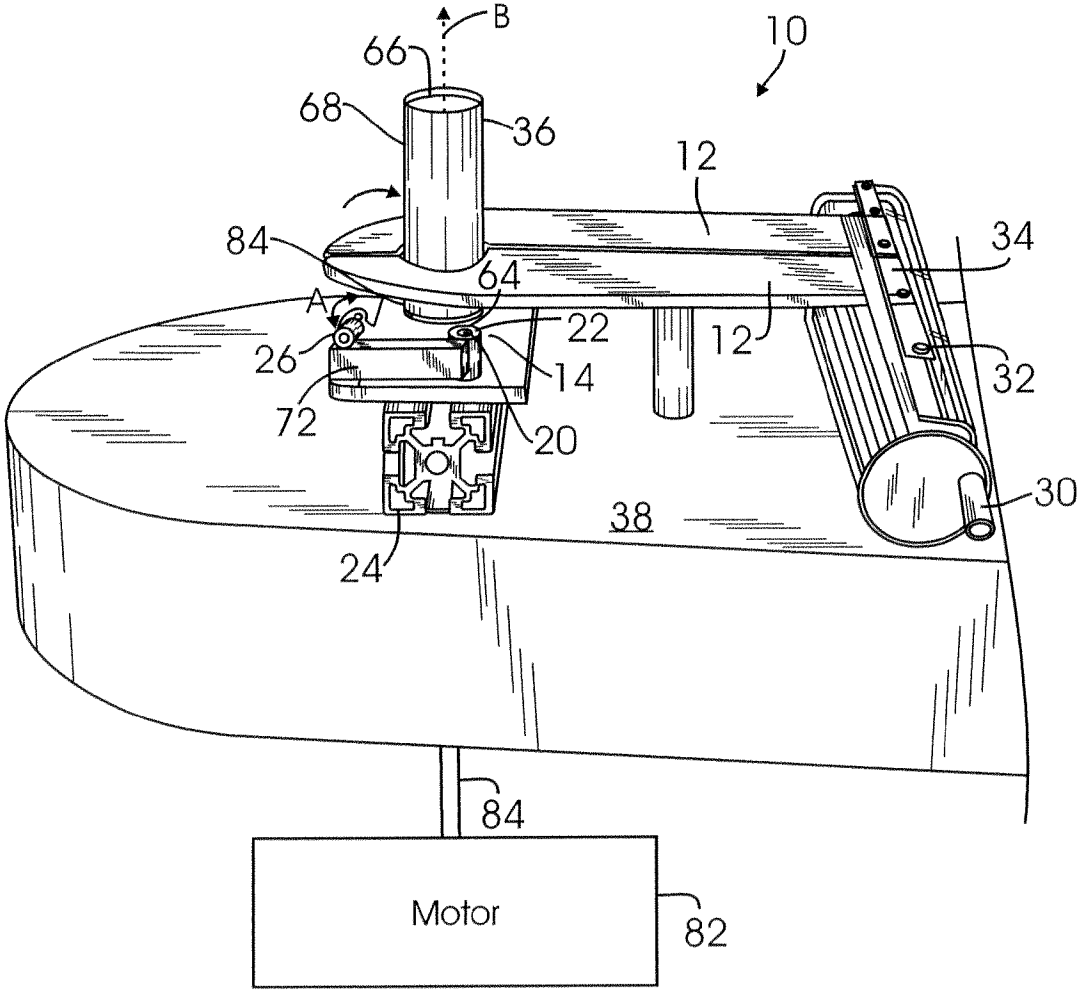
FIG. 2 is another perspective view of a cleaning apparatus for cleaning a tubular member, showing a clamping element.

As shown in FIG. 2, an adjustable clamp arm 12 is used for securing a tubular member 36 in a vertical position above the platform 38 and within the cleaning apparatus 10. The adjustable clamp arm 12 may be operated by any known or desired means, such as a hand crank 30 that is rotated to activate a rack-and-pinion system 32 to open and close the adjustable clamp arm 12. A guard 34 may be used to prevent access to the moving parts of the rack-and-pinion system 32.

When the tubular member 36 is clamped within the cleaning apparatus 10, a lower edge 84, of the tubular member 36, will be between the first inner operating element 18 and the first outer operating element 20.

A motor 82, operatively connected to a shaft 84, may drive the shaft 84 to revolve (or rotate) the slide rail 24 and/or the first sliding base 14. The motor 82 may revolve at a predetermined speeds, for example, 300 revolutions per minute. The slide rail 24 is preferably revolved (for example, in direction A), whereby centrifugal force will urge the first base 14 and the second base 16 (shown in FIG. 1) to move radially outward from a centerline or longitudinal axis B of the tubular member 36, such that the first inner operating element 19 (shown in FIG. 1) will move radially outward and abrade the inner diameter 66 of the tubular member 36.

With the tubular member 36 clamped in a vertical position above the platform 38, the first sliding base 14 is revolved (or rotated) about the longitudinal axis B of the tubular member 36 (either revolving along with the slide rail 24 or revolving independently from the slide rail 24. The present invention may operate without a slide rail 24).

Figure 3:
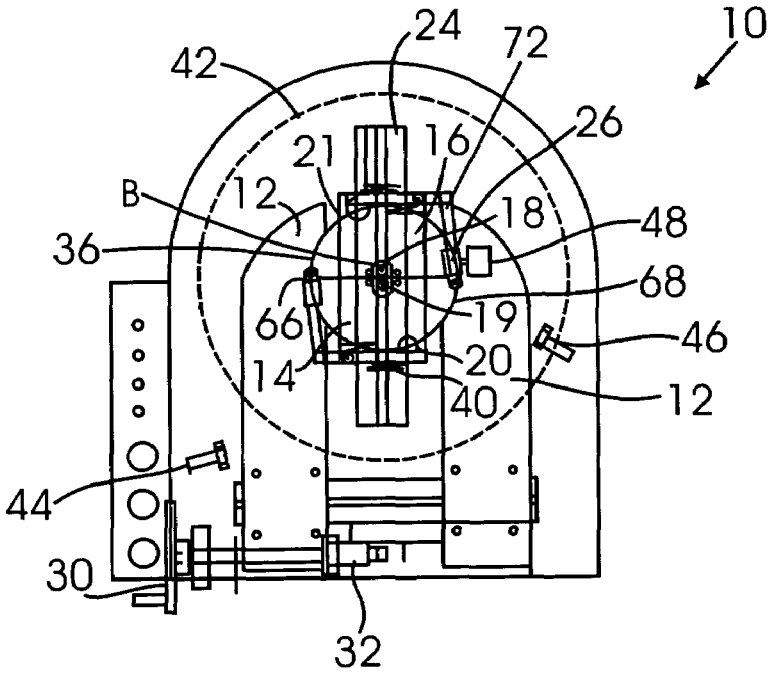
FIG. 3 is an elevational view of FIG. 2.

As shown in FIG. 3, when the slide rail 24 is revolved (or rotated), the first outer operating element 20 and the second outer operating element 21 move radially inward (for example, towards the axis B of the tubular member 36) and abrade the outer diameter 68 of the tubular member 36. The first outer operating element 20 may comprise a first counterweight 26 slidably attached to the first outer operating element 20. Likewise, a second counterweight 27 may be slidably attached to the second outer operating element 21. The first counterweight 26 and the second counterweight 27 may be made from any metal, such as steel.

A holding element 40, such as an alligator clip may be mounted to first outer operating element 20 (or second outer operating element 21) to be adapted to secure the abrasive material 22 (shown in FIG. 1) to the first outer operating element 20 (or the second outer operating element 21) so that the abrasive material 22 does not fall off while the first inner operating element 18 (or the second inner operating element 19) and the first outer operating element 20 (or the second outer operating element 21) revolve (or rotate). The slide rail 24 revolves (or rotates) about the tubular member 36 with a circular motion within a swing area 42 (shown in FIG. 3). As the slide rail 24 revolves (or rotates), the first sliding base may slide, guided within the slide rail 24, to move radially outward such that the first inner operating element 18 contacts an inner diameter 66 of the tubular member 36. Likewise, the second sliding base 16 may slide, guided within the slide rail 24, to move radially outward such that the second inner operating element 19 contacts the inner diameter 66 of the tubular member 36.

The first inner operating element 18 and the second inner operating element 19 clean the inner diameter 66 of the tubular member 36, such as by friction, abrasion, or scraping. Cleaning the tubular member may be assisted with an abrasive material 22 (such as an abrasive strip) held on the outer surface 62 of the first inner operating element 18 (and/or the outer surface 63 of the second inner operating element 19), as shown in FIG. 1.

Continuing with FIG. 3, the cleaning apparatus 10 may further comprise a revolution counter 44 (such as the electromagnetic detector, model no. MP-910 manufactured by the Ono Sokki Co., Ltd. of Yokohama, Japan) for counting a number of slide rail 24 revolutions (or rotations).

The cleaning apparatus 10 may further comprise a tube edge detector 46 for detecting the presence or absence of the tubular member 36 within the cleaning apparatus 10. The tube edge detector 46 may be a photoelectric sensor containing a photoelectric emitter and a photoelectric receiver (such as the photoelectric sensor model no. PZ2 manufactured by the Keyence Corporation of Osaka, Japan).

A clamp micro switch 48 (such as the micro detector switch model no. PD121 manufactured by the SAMWON Electric Co., Ltd. of Chungnam-Do, South Korea) may be used for ensuring that the clamp arm 12 secures the tubular member 36.

Figure 4A:
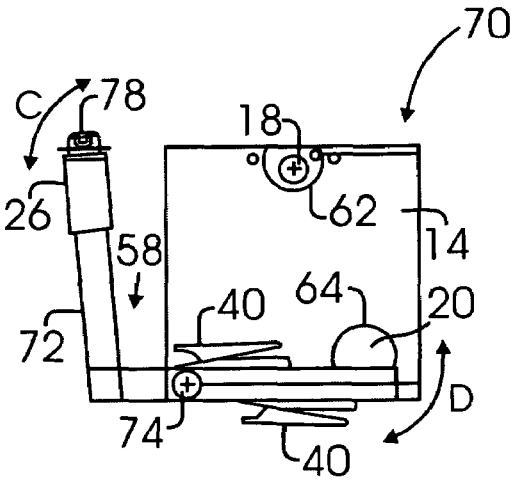
FIG. 4A is a partial elevational view showing a centrifugal cleaning assembly of the present invention.

In FIG. 4A a centrifugal cleaning assembly 70 is shown, according to another embodiment of the present invention. The first outer operating element 20 may comprise a pinch arm shaft 72 with the counterweight 26 attached. The pinch arm shaft 72 may be made from aluminum.

The centrifugal cleaning assembly 70 revolves (or rotates) such that the first sliding base 14 moves clockwise or counterclockwise (anti-clockwise). As the centrifugal cleaning assembly 70 moves in a circular motion, the counterweight 26 moves in direction C while the first outer operating element 20 moves in direction D.

As a speed of revolution (or rotation) of the centrifugal cleaning assembly 70 increases, a centrifugal force and a centripetal force are exerted within the centrifugal cleaning assembly 70. For example, if the counterweight 26 is more massive (heavier) than the first outer operating element 20, then the centrifugal force and the centripetal force cause the counterweight 26 to move away from the general location of the first inner operating element 18.

Then, the first outer operating element 20 pivots around a pivot point 74 such that an outer surface 64 of the first outer operating element 20 is urged (for example, radially inward) towards the general location of the first inner operating element 18. Thus, the outer operating element 20 moves radially inward to contact the outer diameter 68 of the tubular member 36 (as shown in FIGS. 2 and 3).

Figure 4B:
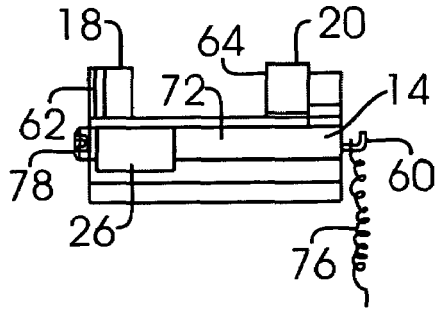
FIG. 4B is a side view of the centrifugal cleaning assembly of FIG. 4A.

As shown in FIG. 4B, the first sliding base 14 may include a spring hook 60 for connecting a spring 76 to the first outer operating element 20 to resiliently urge the first sliding base 14 towards a center of rotation (such as the axis B of the tubular member 36, shown in FIG. 2) of the slide rail 24.

Figure 5:
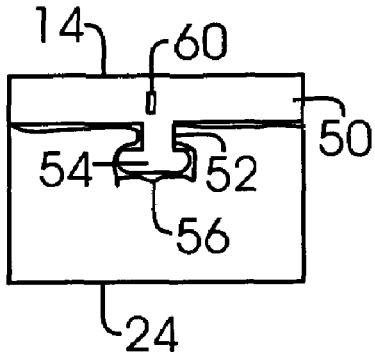
FIG. 5 is a partial side view, of a first sliding base within a slide rail of the cleaning apparatus of the present invention.

FIG. 5 shows the first sliding base 14, in isolation, slidably attached to a slide rail 24. It is to be understood that any description of the first sliding base 14 may be considered to be equivalently descriptive of the second sliding base 16 (shown in FIG. 1). The first sliding base 14 comprises a slab 50 integral with a neck 52. At an end of the neck 52, a foot 54, wider than the neck 52, is generally parallel with the slab 50 for sliding movement within the dimensions of a slot 56 within the slide rail 24.

Figure 6:
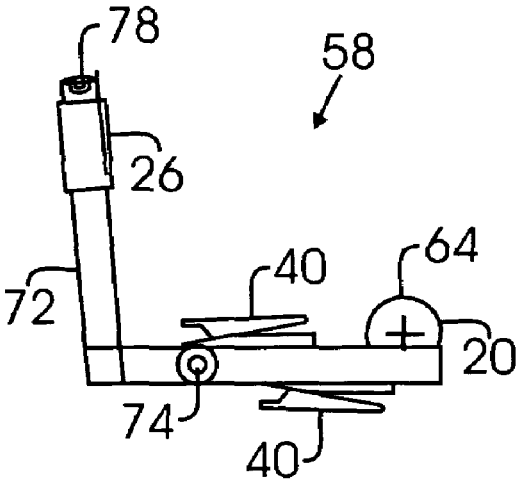
FIG. 6 is a partial side view of a pinch arm assembly of the cleaning apparatus of the present invention.

FIG. 6 is a side view of a pinch arm assembly 58, similar to the pinch arm assembly 58 shown in FIG. 4A. The counterweight 26 may be removed from the pinch arm shaft 72 by removing a counterweight nut 78 and removing the counterweight 26 from the pinch arm shaft 72. A different counterweight 26 may be placed onto the pinch arm shaft 72 and the counterweight nut 78 may be replaced and tightened onto the pinch arm shaft 72.

One reason for changing counterweights 26 may be to replace a first counterweight 26 with a second counterweight 27 that may be more massive (heavier) or less massive (lighter) than the first counterweight 26. Using counterweights 26,27 of different masses may affect the relative centrifugal forces and centripetal forces that act upon the first outer operating element 20, as described above regarding FIG. 4A.

Figure 7:
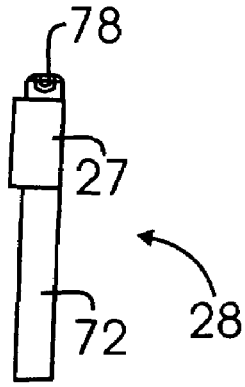
FIG. 7 is a side view of the pinch arm, of FIG. 6.

FIG. 7 is a side view of a pinch arm 28, which may be separated from the pinch arm assembly 58.

Figure 8:
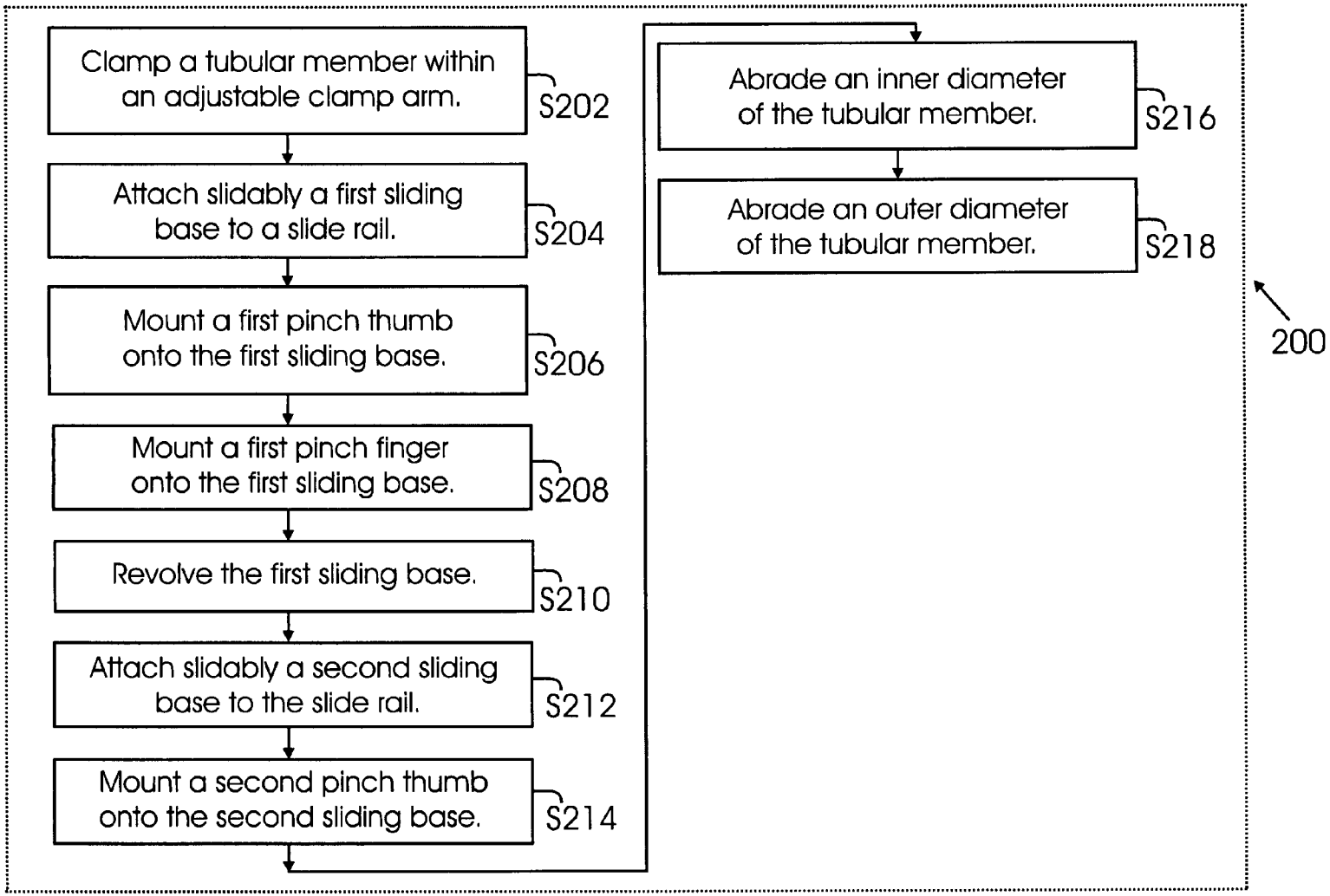
FIG. 8 is a flow chart of a method for edge cleaning a tubular member, in accord with the present invention.

FIG. 8 shows a flow chart of a method 200 for edge cleaning a tubular member. The method 200 may comprise a step S202 of clamping a tubular member within an adjustable clamp arm. A step S204 may comprise attaching slidably a first sliding base to a slide rail; while mounting a first inner operating element onto the first sliding base may comprise a step S206. Mounting a first outer operating element (such as a first pinch finger) onto the first sliding base may comprise a step S208. A step S210 may comprise revolving the first sliding base (for example, rotating the first sliding base with the slide rail about the long axis B of the tubular member).

The first sliding base may revolve in a manner and direction so as to urge the first inner operating element to move radially outward, so that the pinch thumb (with or without an abrasive material on the outer surface) may contact an inner surface along the inner diameter of the tubular member. Likewise, the first outer operating element moves radially inward, so that the first outer operating element (with or without an abrasive material on the outer surface) may contact an outer surface along the outer diameter of the tubular member.

The method 200 may be practiced further by performing a step S212 of attaching slidably a second sliding base to the slide rail, so that the first sliding base and the second sliding base may slide freely and independently in either a radially inward direction or a radially outward direction. The slide rail may serve to guide and control the radial translation of the first sliding base and the second sliding base.

The method 200 may further comprise a step S214 of mounting a second pinch thumb onto the second sliding base.

A step S216 may comprise abrading an inner diameter of the tubular member (for example, when the first inner operating element makes contact with the inner diameter of the tubular member). Likewise, a step S218 may comprise abrading an outer diameter of the tubular member (for example, when the first outer operating element makes contact with the outer diameter of the tubular member).

Although the present invention has been described with reference to specific embodiments, these embodiments are illustrative only and not limiting. Many other applications and embodiments of the present invention will be apparent in light of this disclosure and the following claims.

The invention claimed is:

1. An apparatus for cleaning a portion of a tubular member, comprising:

a platform;

a motor operatively connected to a shaft;

a first sliding base driven by the shaft to revolve generally parallel to the platform;

a first pinch thumb, including an outer surface, mounted onto the first sliding base to revolve with the first sliding base;

a first pinch finger, including an outer surface, mounted onto the first sliding base; and an adjustable clamp arm adapted to secure a tubular member above the platform and adjacent the first sliding base;

wherein, after the adjustable clamp arm secures the tubular member above the platform, the first sliding base revolves to urge the first pinch thumb to move radially outward to contact an inner diameter of the tubular member and the first pinch finger moves radially inward to contact an outer diameter of the tubular member.

2. The apparatus of claim 1, further comprising a slide rail mounted onto the platform and slidably attached to the first sliding base for revolving with the first sliding base.

3. The apparatus of claim 1, further comprising a second sliding base that revolves xvith the first sliding base.

4. The apparatus of claim 3, further comprising a second pinch thumb, including an outer surface, mounted onto the second sliding base.

5. The apparatus of claim 1, wherein the first sliding base includes a spring hook for connecting a spring to the first pinch finger to resiliently urge the first sliding base towards a center of rotation of the slide rail.

6. The apparatus of claim 1, further comprising a revolution counter for counting a number of first sliding base revolutions.

7. The apparatus of claim 1, further comprising a tube edge detector for detecting the presence or absence of the tubular member within the apparatus.

8. The apparatus of claim 1, further comprising a clamp micro switch for ensuring that the clamp arm secures the tubular member.

9. The apparatus of claim 1, further comprising an abrasive material held on the outer surface of the first pinch thumb.

10. An apparatus for cleaning a portion of a tubular member, comprising:

a motor operatively connected to a shaft;

a slide rail operatively connected to the shaft and situated to revolve above a platform;

a first sliding base slidably attached to the slide rail for revolving with the slide rail;

a second sliding base slidably attached to the slide rail for revolving with the slide rail and the first sliding base;

a first pinch thumb, including an outer surface, mounted onto the first sliding base;

a second pinch thumb, including an outer surface, mounted onto the second sliding base;

an abrasive material held on the outer surface of each of the first pinch thumb and the second pinch thumb;

a first pinch finger, including an outer surface, mounted onto the first sliding base;

a second pinch finger, including an outer surface, mounted onto the second sliding base;

an abrasive material held on the outer surface of each of the first pinch finger and the second pinch finger; and an adjustable clamp arm adapted to secure a tubular member above the platform;

whereby when the slide rail is revolved, about the longitudinal axis of the tubular member, the first sliding base and the second sliding base will move radially outward such that the first pinch thumb and the second pinch thumb are moved radially outward to contact an inner diameter of the tubular member and the first pinch finger and the second pinch finger will be moved radially inward to contact the outer diameter of the tubular member.

11. The apparatus of claim 10, wherein the abrasive material held on the outer surface of the first pinch thumb abrades the inner diameter of the tubular member.

12. The apparatus of claim 10, wherein the abrasive material held on the outer surface of the first pinch finger abrades the outer diameter of the tubular member.

13. The apparatus of claim 10, further comprising a first counterweight slidably attached to the first pinch finger and a second counterweight slidably attached to the second pinch finger.

14. The apparatus of claim 10, further comprising an alligator clip adapted to secure the abrasive material to the first pinch finger.

15. The apparatus of claim 10, wherein the first sliding base includes a spring hook for connecting a spring to the first pinch finger to resiliently urge the first sliding base towards a center of rotation of the slide rail.

16. A method for edge cleaning a portion of a tubular member, comprising:

clamping a tubular member within an adjustable clamp arm;

attaching slidably a first sliding base to a slide rail;

mounting a first pinch thumb onto the first sliding base;

mounting a first pinch finger onto the first sliding base; and revolving the first sliding base;

whereby the first sliding base will urge the first pinch thumb to move radially outward to contact an inner diameter of the tubular member and the first pinch finger will move radially inward to contact an outer diameter of the tubular member.

17. The method of claim 16, further comprising attaching slidably a second sliding base to the slide rail.

18. The method of claim 17, further comprising mounting a second pinch thumb onto the second sliding base.

19. The method of claim 16, further comprising abrading the inner diameter of the tubular member.

20. The method of claim 16, further comprising abrading the outer diameter of the tubular member.

* * * * *